US005312653A

United States Patent [19]

Buchanan

[11] Patent Number: 5,312,653

[45] Date of Patent: May 17, 1994

[54] NIOBIUM CARBIDE ALLOY COATING PROCESS FOR IMPROVING THE EROSION RESISTANCE OF A METAL SURFACE

[76] Inventor: Edward R. Buchanan, 31 Washington Park, Maplewood, N.J. 07040

[21] Appl. No.: 995,149

[22] Filed: Dec. 22, 1992

Related U.S. Application Data

[63] Continuation-in-part of Ser. No. 716,543, Jun. 17, 1991, abandoned.

[51] Int. Cl.[5] ..... B05D 1/08

[52] U.S. Cl. ..... 427/451; 427/455; 427/456; 427/427

[58] Field of Search ..... 427/451, 455, 456, 427

[56] References Cited

U.S. PATENT DOCUMENTS

| | | | |
|---|---|---|---|
| 2,920,001 | 1/1960 | Smith et al. | 427/455 |
| 3,617,358 | 11/1971 | Dittrich | 427/456 |
| 4,019,875 | 6/1975 | Dittrich et al. | 427/456 |
| 4,328,257 | 5/1982 | Muehlberger et al. | 427/456 |
| 4,460,421 | 7/1984 | Booth et al. | 156/351 |

*Primary Examiner*—Shrive Beck
*Assistant Examiner*—Benjamin L. Utech
*Attorney, Agent, or Firm*—Ralph H. Dougherty

[57] ABSTRACT

A method of improving the erosion resistance of the surface of a metal substrate by the technique of applying a dense and adherent alloy coating comprised of niobium carbide in a ductile matrix such as cobalt-chromium to the substrate surface using a hypersonic flame spray gun.

22 Claims, 1 Drawing Sheet

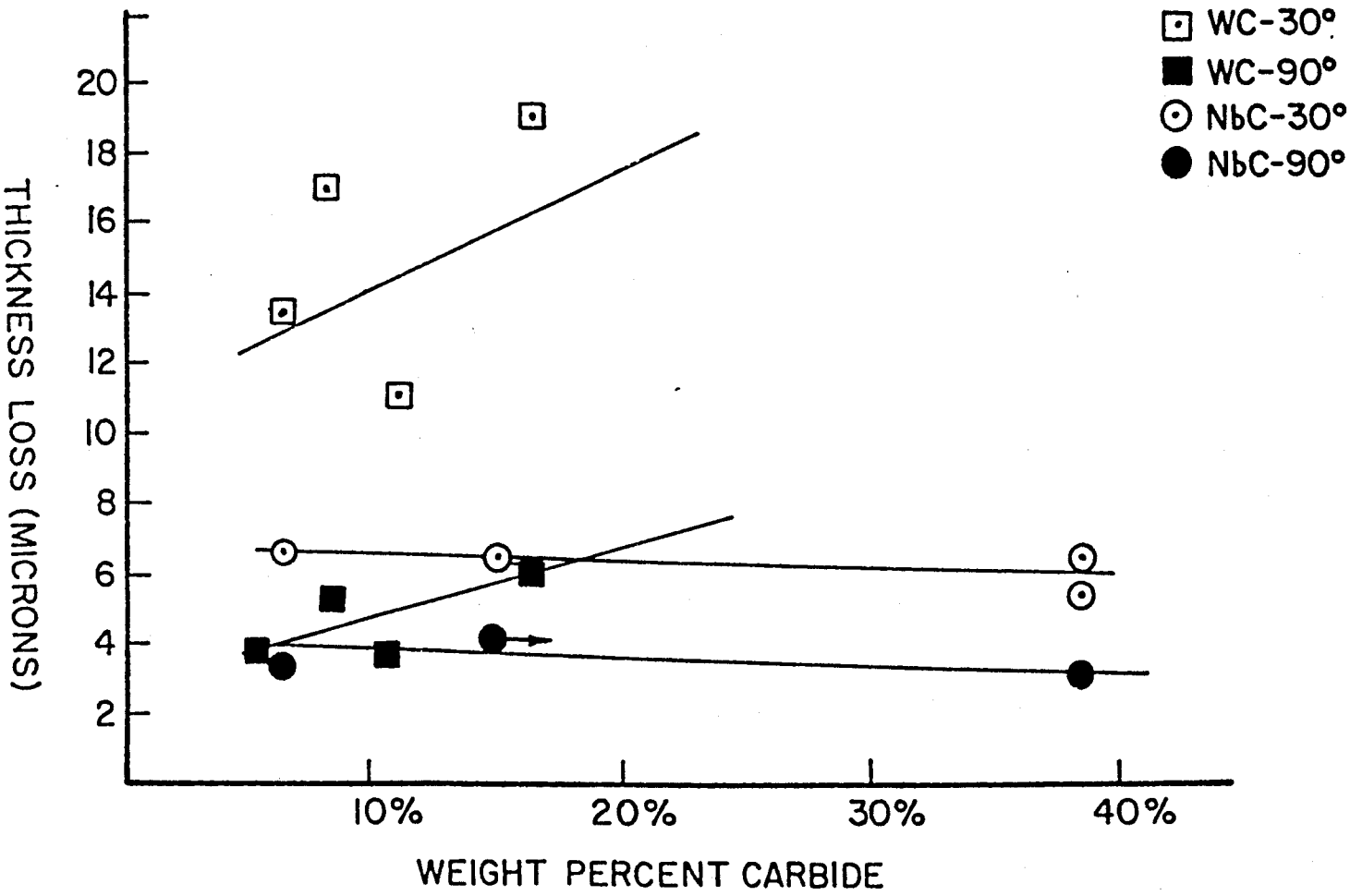
WC-30°
WC-90°
NbC-30°
NbC-90°
THICKNESS LOSS (MICRONS)
20
18
16
14
12
10
8
6
4
2
10%
20%
30%
40%
WEIGHT PERCENT CARBIDE

NIOBIUM CARBIDE ALLOY COATING PROCESS FOR IMPROVING THE EROSION RESISTANCE OF A METAL SURFACE

CROSS REFERENCE TO RELATED APPLICATION

This application is a continuation-in-part of my copending U.S. patent application Ser. No. 07/716,543, filed Jun 17, 1991, now abandoned.

FIELD OF THE INVENTION

The present invention relates to a method for improving the erosion resistance of the surface of a metal object by the technique of applying a dense and adherent coating to its surface using a hypersonic flame spray coating technique. The invention is particularly applicable to tubing for heat exchangers.

BACKGROUND OF THE INVENTION

Erosion is the wastage of objects by the impingement of hard particles traveling in a gaseous or liquid fluid. Several factors which control the rate of wastage of a given surface are:

- the relative hardness of the erosive media and the surface being eroded;
- the temperature, size, shape, velocity, and angle of impingement of the eroding media; and
- the smoothness, ductility, and integrity (lack of porosity) of the surface being eroded.

Other factors may also be considered. In instances where multi-phase materials are specified to enhance erosion resistance (such as cemented carbides), the size and shape of the second phase carbide particles also have a direct bearing on the erosion resistance of a given surface. Because of the complexity and interrelationship of all of these factors, it often is not possible to predict whether the erosion resistance of a given surface will be good under a specific set of erosive conditions.

The present invention comprehends a material which has much better erosion resistance under a widely varying set of erosive conditions than many materials which are customarily specified for use in erosive environments. The subject material is a cemented carbide comprised of niobium carbide in a metal matrix, along with a process for applying the material to a metal substrate. The erosion resistance of such material has been evaluated as a coating which has been applied onto the surface of steel specimens.

The subject invention was made during the course of a Small Business Innovative Research grant to Manhattan Turbine Corporation by the Department of Energy. This grant was awarded following submission of a proposal in response to a solicitation requesting novel solutions for the control of erosion in fluidized bed combustors.

The combustion of coal in a fluidized bed combustor results in the formation of large quantities of ash, which is comprised principally of silica, and, as such, is highly erosive. This results in the degradation of heat exchanger tubing in the fluidized bed combustor. The specific degradation is of two primary types: erosion/corrosion of "in-bed" tubing in the 450° C. temperature range; and erosion of tubing in the 300° C. range at the base of the waterwall.

A large number of protective coating systems have been used by various fluidized bed combustor manufacturers to slow the rate of wastage in heat exchanger tubing. In most instances, the coatings applied have not extended the life of the tubing sufficiently to be considered cost effective.

DESCRIPTION OF THE PRIOR ART

In Switzerland about 1915, Max Schoop found that by injecting metal powder into hot gases formed by the combustion of oxygen and a fuel gas such as propane or acetylene, the heat-softened powder would adhere to the surface of a substrate to which the effluent had been directed. This flame spray coating process, which is known as "metallizing", has been a standard method for applying metal coatings for several decades. During the 1950s, the plasma spray coating process was developed, by which metal powder is injected into the hot gases exiting from a plasma chamber in which an electric arc has been generated, and directed toward a substrate. The plasma spray process produces higher operating temperatures than the flame spray process, and can apply denser and more adherent coatings.

Low metal powder velocities characterize both the flame spray process and the plasma spray process, normally on the order of 50 to 150 feet per second. The hypersonic spray process is capable of applying powders at extremely high powder velocities in the range of from about 1500 to about 3500 feet per second.

Applicant is aware of certain U. S. Patents concerning wear-resistant or flame spray coatings:

| U.S. Pat. No. | Inventor | Issue Date | Title |
|---|---|---|---|
| 3,419,415 | Dittrich | Dec. 31, 1968 | COMPOSITE CARBIDE FLAME SPRAY MATERIAL |
| 4,806,394 | Steine | Feb. 21, 1989 | METHOD FOR PRODUCING A WEAR-RESISTANT, TITANIUM-CARBIDE CONTAINING LAYER ON A METAL BASE |

Dittrich U.S. Pat. No. 3,419,415 teaches flame-spray coating of a carbon-containing composite having no binder. It has been found that when a carbide containing no binder is flame sprayed as a coating, the carbide decarburizes in the presence of oxygen to a lower order carbide. For instance, WC (tungsten carbide) becomes $W_2C$, or under certain conditions oxidizes to metallic tungsten and $CO_2$. In order to carry out Dittrich's method of making coatings of solid carbide without a binder, a spray powder is formed of a refractory metal carbide without a binder, but having an excess of carbon in the spray powder. Dittrich states that his spray powder requires at least 5% excess carbon, and preferably 20 to 50% excess carbon. The excess carbon makes up for the loss of carbon in Dittrich's process, and further, an exothermic reaction takes place, raising the overall temperature of the process. The binder which Dittrich seeks to avoid is normally cobalt, nickel, or iron, or a combination thereof. Dittrich's excess carbon oxidizes to $CO_2$ and comes off as a gas. This excess carbon is required in the Dittrich process in order to end up with a stoichiometric carbide.

When niobium coatings are sprayed by conventional techniques, they will oxidize, and thus they have been poor when applied by conventional means, such as plasma coating. Standard plasma coating techniques apply a porous coating, as reported in a paper on Plasma Sprayed Niobium Carbide Coatings presented at the 1990 Thermal Spray Symposium (O. Knotek, R. Elsing and I. Pragnyono, "On Plasma Sprayed NbC-based Hard Material Coatings", Proceedings of the 1990 Thermal Spray Symposium, 1990, pp 307-313).

In the present invention, a niobium carbide powder coating is applied hypersonically with a high velocity flame spray gun, the detrimental oxidation which normally occurs is minimized, and the coating unexpectedly is very good, being both tightly adherent and nonporous.

It is well known that niobium carbide materials, when sprayed using conventional flame spray or plasma spray, oxidize dramatically. Surprisingly, it has been found that by using hypersonic flame spray coating a minimum of oxidation occurs.

Steine U.S. Pat. No. 4,806,394 is concerned with titanium carbide coatings, and only optionally includes a minor amount of niobium in the matrix alloy, up to a maximum of 1.5%.

SUMMARY OF THE INVENTION

The present invention is a process for improving the erosion resistance of the surface of a metal object whereby a dense and adherent coating formed on the surface of an object by applying a metal alloy powder to the surface of the object at high velocity, preferably using a hypersonic flame spray gun, the preferred powder being an alloy comprised of a ductile matrix and a hard carbide, preferably niobium carbide. The invention also comprehends the resultant article, which is an erosion-resistant metal substrate having a dense adherent coating thereon consisting of a ductile alloy matrix incorporating a hard carbide therein.

OBJECTS OF THE INVENTION

The principal object of the invention is to provide a method of improving the erosion resistance of the surface of a metal object.

A further object of this invention is to provide a method of applying a dense and adherent coating to the surface of a metal object.

Another object of the invention is to provide a method for applying a coating containing a high fraction of niobium carbide to a metal substrate.

Another object of the invention is to provide an erosion resistant metal article having a dense and adherent coating.

BRIEF DESCRIPTION OF THE DRAWINGS

The foregoing and other objects will become more readily apparent by referring to the following detailed description and the appended drawing in which:

The single Figure is a graph showing the effect of carbide additions on metal erosion rates.

DETAILED DESCRIPTION

The invented process includes the steps of selecting a metal substrate, providing an alloy powder comprising a ductile matrix incorporating a hard carbide therein, and applying the powder coating to the substrate at high temperature created by the combustion of an oxygen-fuel mixture, and at high powder velocity. The coating is an alloy comprised of niobium carbide in a ductile chromium-containing ferritic matrix. The coating is applied at high velocities using a hypersonic flame spray gun.

In operation, the metal matrix for the alloy powder is preferably a cobalt-chromium matrix consisting essentially of 50 to 80 percent cobalt and 20 to 50 percent chromium. Other suitable matrices include an iron-base matrix such as iron containing about 25% chromium and about 4% aluminum, and a nickel-base matrix, such as 20% chromium with remainder substantially nickel. From 20 to 95 percent of the alloy matrix is combined with from 5 to 80 percent niobium carbide. The process may also be performed with an amount of niobium carbide comprising 5.5 to eighty percent of the alloy by weight. This can be accomplished by mechanical blending, but it is usually done by pre-alloying. The alloy is provided to the hypersonic flame spray gun in fine powder form and preferably in a size range of from 20 to 40 microns. The powder is injected by means of a carrier gas, preferably nitrogen. The preferred fuel gas for the hypersonic flame spray system is propylene.

The substrate can be any metal, including steel or stainless steel. Depending on the application, the coating may be applied in thicknesses ranging from 0.002 to 0.120 inches.

In the hypersonic flame spray process, as practiced in the present invention, spray powders are injected into the flame of an oxy-fuel combustion jet which has been accelerated to approximately 2,000 ft/sec (1,500 to 3,500 ft/sec). Preferably, the powders are injected into the center of the combustion jet. The resulting spray deposit is comprised of individual powder particles which impact the substrate with sufficient kinetic energy that they flatten out on impact. The resulting deposit has much less porosity and greater bond strength than coatings applied by spray techniques which apply powder at lower velocities, such as plasma spray and conventional flame spray processes. This is an important consideration with regard to the subject invention, because it has been shown that the formation of a fine-grained, dense microstructure is a criterion for good erosion resistance.

Approximately thirty (30) different coatings were applied using the hypersonic flame spray system. The erosion resistance of these coatings was compared to the erosion resistance of several coatings applied using conventional techniques. The erosion resistance was determined using the erosion test rig at the University of California's Berkeley Laboratory. The test rig attempted to simulate two specific erosive conditions inside a fluidized bed combustor:

a) an environment which simulated the "in-bed" condition for the convection pass of a fluidized bed combustor; and b) an environment which simulated the condition at the base of the waterwall section of a circulating fluidized bed combustor.

The specific test parameters for the two test conditions are:

| | |
|---|---|
| Set A | |
| Temperature | 450° C. |
| Gas | air |
| Erodant | |
| composition | $SiO_2$ |
| shape | angular |
| size | 250 microns |
| velocity | 20 m/s |
| impact angle | 90° |
| solids loading | 100 gms |
| test duration | 4 hours |

-continued

| | |
|---|---|
| Set B | |
| Temperature | 300° C. |
| Gas | air |
| Erodant | |
| composition | $SiO_2$ |
| shape | angular |
| size | 100 microns |
| velocity | 30 m/s |
| impact angle | 25° |
| solids loading | 100 gms |
| test duration | 4 hours |

Three test tabs were prepared for each coating. The test tabs were 1026 carbon steel, 2 inches long, one inch wide, and ⅜ inch thick. Each tab was cleaned in a solvent to remove hydrocarbon contaminants, and then grit blasted on one side with 16 mesh aluminum oxide prior to spray. Each specimen was then coated with the approximate powder to between 0.010 to 0.015 inches in thickness.

Following spray, the specimens were sent to the University of California's Berkeley Laboratory. The coated face of each specimen was then ground to provide a smooth surface, after which one specimen was erosion tested at each of the above two test conditions. After the completion of erosion testing, all specimens were evaluated metallographically and the weight loss and thickness loss of the coating was determined.

The superiority of the niobium carbide coatings relative to other materials is illustrated by several examples.

EXAMPLE 1

The erosion resistance of two different carbide materials were compared to that of the matrix alloy by preparing samples of three separate coatings. Three test tabs were prepared of each coating material. Each of the coating compositions were applied using the hypersonic flame spray process. The compositions of the three coatings were as follows:

1. a matrix alloy nominally containing 75% cobalt and 25% chromium by weight;
2. an alloy containing 7% by weight of niobium carbide in the above cobalt-chromium matrix alloy; and
3. an alloy containing 6.4% by weight of tungsten carbide in the above cobalt-chromium matrix alloy.

The carbide contents of the latter two alloys were determined by chemical analysis of the two coatings following deposition by hypersonic flame spray.

Both of the carbide materials showed a large increase in erosion resistance in comparison to matrix alloy, as shown in Table I. In particular, the coating containing niobium carbide was much more erosion resistant than either the matrix alloy sample or the sample containing approximately the same amount of tungsten carbide. For example, the depth of attack at the 300° C., 30° condition was a factor of three less than the depth of attack in the matrix sample, and half that of the tungsten carbide sample. At the 450° C., 90° test condition, the depth of attack in the niobium carbide sample was approximately a factor of two less than the matrix alloy sample, and about ten percent better than the tungsten carbide sample.

The primary significance of the results shown in Table I is that the coating containing niobium carbide is significantly more resistant to erosion attack than the coating containing tungsten carbide. Tungsten carbide is widely used throughout the world as an additive to metal alloys for the purpose of improving their erosion resistance, and the example illustrated above clearly demonstrates that the sample containing niobium carbide is clearly more resistant to erosion than the sample containing tungsten carbide. This phenomenon has been observed at five separate test conditions.

TABLE I

Erosion Resistance of Co(Cr) Alloys as Affected by Carbide Addition

| Alloy | Surface Wastage 300° C./30° Impingement | Surface Wastage 450° C./90° Impingement |
|---|---|---|
| 75% Co—25% Cr | 19.5 μm | 6.8 μm |
| (75% Co—25% Cr) +6.4% WC | 13.3 | 3.8 |
| (75% Co—25% Cr) +7.0% NbC | 6.5 | 3.5 |

A summary of these results is shown in FIG. 1.

EXAMPLE 2

In another example, samples were coated with an alloy comprising 38.6 weight percent niobium carbide in a matrix of cobalt-chromium. As was the case in Example 1, the samples were coated using the hypersonic flame spray process. The carbide content was determined by actual analysis of coated samples. Another group of samples were coated with a commercial nickel-base self fluxing alloy whose composition was reported by the powder manufacturer to be Ni-15Cr-4Si-3.5B-39.4WC. In this case, the nickel-base self-fluxing alloy was applied using a conventional flame spray gu and then fused by heating the samples to approximately 2,000° F. to melt and densify the coating and bond it to the base metal. This particular coating composition is widely used in industry because it has excellent erosion resistance. The act of melting the coating to consolidate it after one application eliminates most of the porosity, which is considered by most of the workers in the field to be one of the criteria for good erosion resistance.

Both of these groups of samples, containing an equivalent content of carbide by weight, were erosion tested as described previously. The results, shown in Table II, illustrates that the erosion resistance of the unfused carbide coating is approximately a factor of two better than that of the fused coating containing tungsten carbide and applied using conventional flame spraying.

The significance of the comparison shown in Example 2 is that an unfused coating (generally considered to be inferior in erosion resistance to a fused coating due to the higher porosity content and the lower bond strength) applied by hypersonic flame spray and containing an equivalent amount by weight of niobium carbide to the amount of tungsten carbide contained in the fused coating, has significantly better erosion resistance than the fused coating widely used in industry for its superior erosion resistance.

TABLE II

Erosion of Two Carbide-Containing Alloys as Affected by Means of Application

| Alloy | Application | Surface Wastage 300° C./30° | Surface Wastage 450° C./90° |
|---|---|---|---|
| (75% Co – 25% Cr) + 38.6% NbC | hypersonic | 5.6 μm | 3.1 μm |
| Ni – 15% Cr – 4% Si – 3.5% B – 39.4% WC | spray and fuse | 10.3 | 6.1 |

EXAMPLE 3

A third example illustrates the increase in erosion resistance which is achieved by applying the niobium carbide coating using the hypersonic flame spray process. Two sets of samples were coated with a coating having the same nominal composition. The coating was applied on one set using a conventional plasma spray process.

The coating was applied on the other set of samples using the hypersonic flame spray process.

The samples sprayed using the hypersonic flame spray process were given a 100 hour aging treatment at 1200° F. before erosion testing, and the plasma sprayed samples were not. However, another group of experiments, the results of which are not included here, has demonstrated that this aging treatment had no effect on erosion resistance. The results are thus included here as equivalent.

TABLE III

Erosion of a Niobium-Carbide Alloy as Affected by Technique of Application

| Alloy | Application | Surface Wastage 300° C./30° | Surface Wastage 450° C./90° |
|---|---|---|---|
| (75% Co—25% Cr) +14% NbC | hypersonic | 6.3 μm | 4.0 μm |
| (75% Co—25% Cr) +14% NbC | plasma spray | 15.4 | 5.3 |

These results clearly demonstrate the superiority of the coating applied by the hypersonic application process relative to conventional plasma spray.

EXAMPLE 4

The erosion resistance of several niobium carbide-containing alloys applied using the hypersonic flame spray process were compared to the erosion resistance resulting from several surface treatment processes which are frequently used to enhance erosion resistance. These are illustrated in Table IV.

The data in Table IV show that niobium carbide coatings when applied using the hypersonic flame spray process are much more resistant to erosion attack than many conventional surface treatment processes used to enhance erosion.

TABLE IV

Erosion of Niobium Carbide Coatings in Comparison to Conventional Treatments

| Alloy | Application | Surface Wastage 300° C./30° | Surface Wastage 450° C./90° |
|---|---|---|---|
| (75% Co—25% Cr) +38.6% NbC | hypersonic | 5.6 μm | 3.1 μm |
| 88% WC – 12% Co(Cr) | plasma spray | 20.1 | 15.0 |
| chromium oxide | plasma spray | 14.2 | 6.0 |
| nitride steel | gas nitride | 17.8 | 16.9 |
| chromized steel | pack | 6.5 | 4.7 |
| ConformaClad | cloth/fuse | 8.7 | NR |
| uncoated 2.25% Cr—1% Mo steel | | 24.0 | 8.3 |
| uncoated 304 steel | | 17.5 | 6.3 |

It is believed that the improvement in erosion resistance which has been observed may be related to the lower modulus of elasticity of the niobium carbide. The modulus of elasticity of niobium carbide is less than half that of tungsten carbide, which is widely used for erosive applications. The impact of a foreign particle onto the surface of a multi-phase material such as a cemented carbide causes both the carbide phase and the matrix alloy to yield elastically. In the case of tungsten carbide, there is a large disparity between the moduli of the matrix alloy and the tungsten carbide particles. The stress resulting from impact will create a strain mismatch at the interface between the matrix and carbide particle. If the disparity between the two materials is high, as is the case when the carbide is tungsten carbide, the registry between the carbide particles and the matrix can be breached much more easily than for a low-modulus material such as niobium carbide. The theory to which applicant subscribes is that the property of the lower modulus of elasticity of niobium carbide, in conjunction with the lack of porosity and good adherence of coatings applied using the hypersonic flame spray process, has resulted in outstanding erosion resistance.

SUMMARY OF THE ACHIEVEMENT OF THE OBJECTS OF THE INVENTION

From the foregoing, it is readily apparent that I have invented an improved erosion-resistant coating, and a method for improving the erosion resistance of the surface of a metal object by the technique of applying a powder coating consisting of a ductile alloy matrix including niobium carbide therein, to its surface using a high-velocity flame spray apparatus, such as a hypersonic flame spray gun, thereby forming a dense and adherent erosion-resistant coating.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A process for improving the erosion resistance of the surface of a metal substrate by the technique of applying a powder comprised of niobium carbide in a matrix of a ductile metal alloy, said ductile metal alloy consisting essentially of cobalt and chromium, to the substrate surface by hypersonic flame spray coating at a velocity of 1,500 to 3,500 ft/sec, whereby a dense and adherent alloy coating is formed on said substrate.

2. A process according to claim 1, wherein the amount of niobium carbide comprises at least 5.5 percent of the ductile metal alloy by weight, and not more than eighty percent by weight.

3. A process according to claim 1 wherein the metal alloy consists essentially of 50 to 80 percent cobalt and 20 to 50 percent chromium.

4. A process according to claim 1 wherein the substrate is selected from the group consisting of steel and stainless steel.

5. A process according to claim 1 wherein the powder size of said powder is from about 20 to about 40 microns.

6. A process according to claim 1 wherein the powder is applied to the substrate by a hypersonic flame spray coating gun.

7. A process according to claim 1 wherein the powder is injected into the flame of an oxy-fuel combustion jet which has been accelerated to at least 2,000 ft/sec.

8. A process according to claim 7 wherein the powder is injected into the center of the combustion jet.

9. A process for improving the erosion resistance of the surface of a metal substrate by the technique of applying a powder comprised of niobium carbide in a matrix of a ductile metal alloy, said ductile metal alloy consisting essentially of about 4 percent aluminum and about 25 percent chromium, with balance essentially iron, to the substrate surface by hypersonic flame spray coating at a velocity of 1,500 to 3,500 ft/sec, whereby a dense and adherent alloy coating is formed on said substrate.

10. A process according to claim 9, wherein the amount of niobium carbide comprises at least 5.5 percent of the ductile metal alloy by weight, and not more than eighty percent by weight.

11. A process according to claim 9 wherein the substrate is selected from the group consisting of steel and stainless steel.

12. A process according to claim 9 wherein the powder size of said powder is from about 20 to about 40 microns.

13. A process according to claim 9 wherein the powder is applied to the substrate by a hypersonic flame spray coating gun.

14. A process according to claim 9 wherein the powder is injected into the flame of an oxy-fuel combustion jet which has been accelerated to at least 2,000 ft/sec.

15. A process according to claim 14 wherein the powder is injected into the center of the combustion jet.

16. A process for improving the erosion resistance of the surface of a metal substrate by the technique of applying a powder comprised of niobium carbide in a matrix of a ductile metal alloy, said ductile metal alloy consisting essentially of about 20 percent chromium, with the balance essentially nickel, to the substrate surface by hypersonic flame spray coating at a velocity of 1,500 to 3,500 ft/sec, whereby a dense and adherent alloy coating is formed on said substrate.

17. A process according to claim 16, wherein the amount of niobium carbide comprises at least 5.5 percent of the ductile metal alloy by weight, and not more than eighty percent by weight.

18. A process according to claim 16 wherein the substrate is selected from the group consisting of steel and stainless steel.

19. A process according to claim 16 wherein the powder size of said powder is from about 20 to about 40 microns.

20. A process according to claim 16 wherein the powder is applied to the substrate by a hypersonic flame spray coating gun.

21. A process according to claim 16 wherein the powder is injected into the flame of an oxy-fuel combustion jet which has been accelerated to at least 2,000 ft/sec.

22. A process according to claim 21 wherein the powder is injected into the center of the combustion jet.

* * * * *